US006334388B1

(12) United States Patent
Kimura

(10) Patent No.: US 6,334,388 B1
(45) Date of Patent: Jan. 1, 2002

(54) STENCIL PRINTER WITH CONTROLLED MOVEMENT OF PAPER RACK AND INK DRUM

(75) Inventor: Hitoshi Kimura, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/399,957

(22) Filed: Sep. 20, 1999

(30) Foreign Application Priority Data

Oct. 22, 1998 (JP) ..... 10-300735

(51) Int. Cl.[7] ..... B41L 13/04; B41L 13/16

(52) U.S. Cl. ..... 101/118; 101/116; 271/3.15

(58) Field of Search ..... 101/116, 117, 101/118, 119, 120, 129, 483, 484, 485, DIG. 36; 271/3.15, 9.06, 223; 399/405, 391

(56) References Cited

U.S. PATENT DOCUMENTS 5,165,338 A * 11/1992 Okazaki et al. ..... 101/118
6,026,744 A * 2/2000 Miyata ..... 101/118
6,073,925 A * 6/2000 Sato ..... 271/171

FOREIGN PATENT DOCUMENTS

JP 5-124737 * 5/1993
JP 5-306025 * 11/1993
JP 6-40137 * 2/1994
JP 6-293175 * 10/1994
JP 6-345281 * 12/1994
JP 10-1254 * 1/1998

* cited by examiner

*Primary Examiner*—Leslie J. Grohusky
(74) *Attorney, Agent, or Firm*—Oblon, Spivak, McClelland, Maier & Neustadt, P.C.

(57) ABSTRACT

A stencil printer includes a hollow cylindrical, porous ink drum freely rotatable. A multistage paper feeding device includes a plurality of paper stacking portions and capable of feeding papers of particular size from each paper stacking portion. At least one pair of side fences are mounted on each paper stocking portion for positioning the papers in the widthwise direction of the papers. A rack is positioned to stack the papers or printings each carrying a printed image thereon. An ink drum shifting device shifts the ink drum in the widthwise direction of the papers perpendicular to the direction of conveyance of the papers. A rack shifting device shifts the rack in the widthwise direction of the papers. A storing device stores the position of a center line of a paper transport path for each of the paper stocking portions. A control section controls the operation of the ink drum shifting device and that of the rack shifting device in accordance with the position of the center line stored in the storing device.

16 Claims, 8 Drawing Sheets

STENCIL PRINTER WITH CONTROLLED MOVEMENT OF PAPER RACK AND INK DRUM

BACKGROUND OF THE INVENTION

The present invention relates to a stencil printer and more particularly to a stencil printer of the type including a multistage paper feeding device capable of feeding papers of different kinds and an ink drum shiftable in the widthwise direction of the papers perpendicular to a direction in which the papers are conveyed.

A digital stencil printer is conventional which uses a laminate thermosensitive stencil made up of a thermoplastic resin film and a porous support adhered to each other. The printer includes athermal head for selectively perforating, or cutting, the resin film of the stencil with heat in accordance with image data. After the perforated stencil or master has been wrapped around an ink drum, ink feeding means arranged in the drum feeds an adequate amount of ink to the inner periphery of the drum. A press roller, press drum or similar pressing member presses a paper or similar recording medium against the ink drum so as to transfer the ink from the drum to the paper via the porous portion of the drum and the perforations of the master. As a result, an image represented by the image data is printed on the paper. Usually, a paper feeding device for continuously feeding papers one by one is built in the printer. The paper feeding device generally includes a feed tray to be loaded with a stack of papers and a pair of side fences for guiding the papers in the widthwise direction of the papers.

With the above printer, it is possible to shift the position of an image on the paper in the widthwise direction of the paper perpendicular to the direction of paper conveyance by shifting the feed tray of the paper feeding device in the widthwise direction. However, the adjustment of the shift relying on eyesight and the manual shift of the feed tray cannot easily implement delicate adjustment or accurate adjustment. In light of this, Japanese Patent Laid-Open Publication No. 5-306025, for example, discloses an arrangement for automatically shifting the feed tray of the paper feeding device.

To meet various kinds of needs, a stencil printer including a multistage paper feeding device has recently been proposed. The multistage paper feeding device has a plurality of paper stocking portions and is capable of feeding papers of particular kind from each paper stocking portion. For such a multistage paper feeding device, Japanese Patent Laid-Open Publication No. 6-345281, for example, teaches an arrangement for automatically shifting a plurality of feed trays in the widthwise direction of the papers at the same time.

However, in any one of the conventional arrangements, a discharge tray for receiving papers, or printings, is not shiftable although the feed tray is shiftable. This brings about a problem that when the feed tray is shifted, the resulting printings cannot be accurately positioned on the discharge tray, and a problem that a pair of side fences on the discharge tray must be shifted independently of each other, obstructing easy operation. The arrangement taught in the above Laid-Open Publication No. 6-345281 has a drawback that a complicated construction is necessary for all of the feed trays to be shifted at the same time. Moreover, when the center of any one of the feed trays is deviated, the position of an image on a paper varies and must be adjusted every time the feed tray is selected.

Japanese Patent Laid-Open Publication No. 6-293175, for example, proposes an implementation for promoting accurate positioning of papers on the discharge tray, easy operation of the side fences of the discharge tray and simple construction. The implementation taught in this document is such that the feed tray and discharge tray are fixed in place while the ink drum is shiftable in the widthwise direction of papers. At the time of printing, the ink drum is shifted in the above direction for adjusting the position of an image on a paper.

A problem with the above Laid-Open Publication No. 6-293175 is that if the center line of any one of the feed trays included in the multistage paper feeding device is deviated, then the ink drum must be readjusted in position by troublesome operation every time the feed tray is selected. Another problem is that adjusting the center tray by tray is not practicable without resorting to highly accurate assembly, increasing the cost and reducing design freedom.

Technologies relating to the present invention are also disclosed in, e.g., Japanese Patent Laid-Open Publication Nos. 6-40137, 10-1254, and 5-124737.

SUMMARY OF THE INVENTION

It is therefore an object of the present invention to provide a stencil printer capable of adjusting, when the center of any feed tray of a multistage paper feeding device is deviated, an image position on a paper easily and automatically without increasing the cost.

A stencil printer of the present invention includes a hollow cylindrical, porous ink drum freely rotatable. A multistage paper feeding device includes a plurality of paper stacking portions and capable of feeding papers of particular size from each paper stacking portion. At least one pair of side fences are mounted on each paper stocking portion for positioning the papers in the widthwise direction of the papers. A rack is positioned to stack the papers or printings each carrying a printed image thereon. An ink drum shifting device shifts the ink drum in the width wise direction of the papers perpendicular to the direction of conveyance of the papers. A rack shifting device shifts the rack in the widthwise direction of the papers. A storing device stores the position of a center line of a paper transport path for each of the paper stocking portions. A control section controls the operation of the ink drum shifting device and that of the rack shifting device in accordance with the position of the center line stored in the storing device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
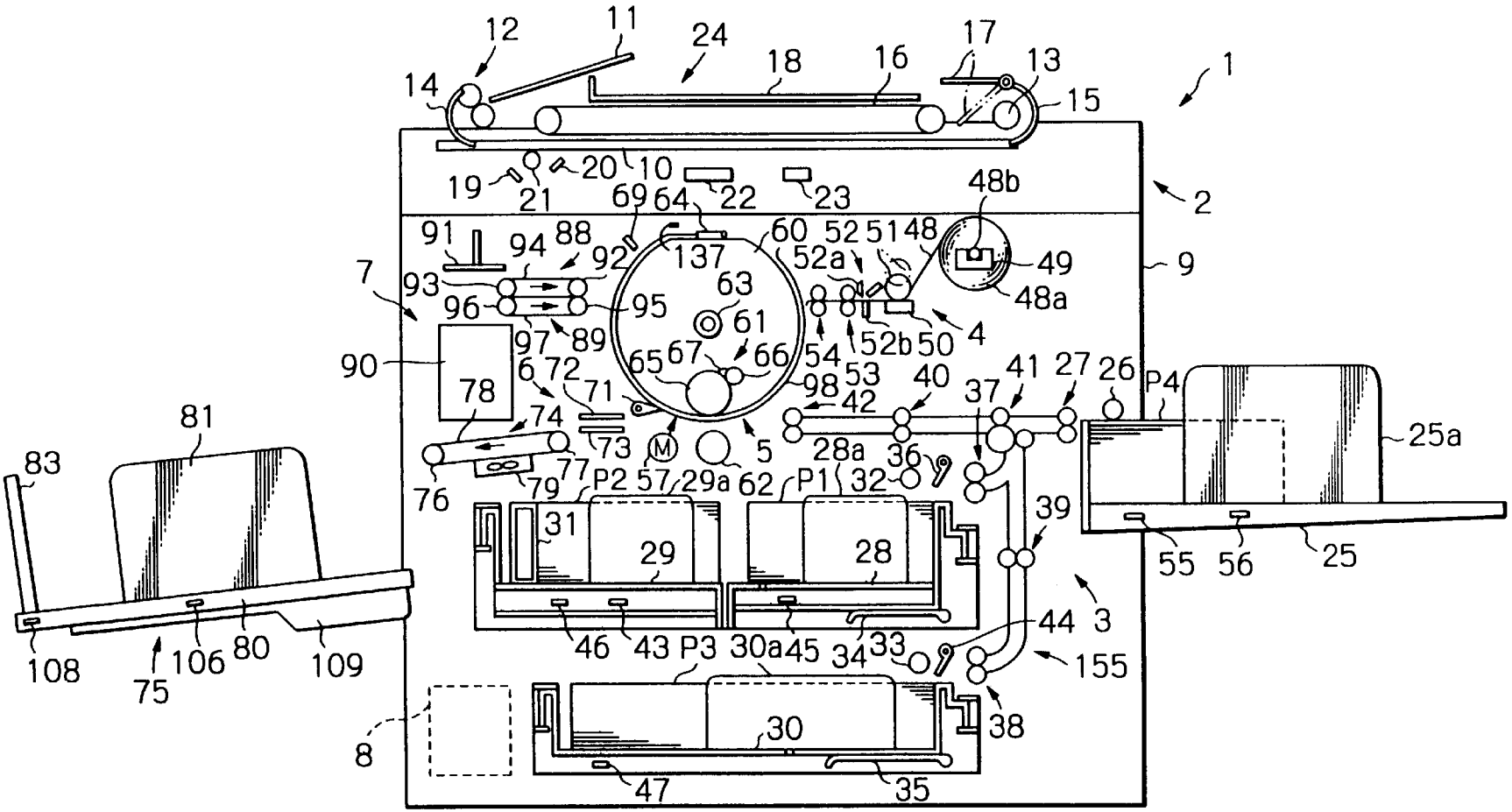
FIG. 1 is a fragmentary front view showing a stencil printer embodying the present invention.

Referring to FIG. 1 of the drawings, a stencil printer embodying the present invention is shown and generally designated by the reference numeral 1. As shown, the stencil printer includes a casing 9 accommodating an image reading section 2, a paper feeding section 3 or multistage paper feeding device 3, a master making section 4, a paper discharging section 6, a master discharging section 7, and a control section 8.

An image reading section 2 is mounted on the top of the casing 9 and includes a glass platen 10 on which a document is to be laid. A document feed tray 11 is used to lay a desired document or documents. A roller pair 12 and a roller 13 convey a document. Guides 14 and 15 respectively adjoin the roller pair 12 and roller 13 for guiding a document being conveyed. A belt 16 conveys a document along the glass platen 10. A flat direction selector 17 switches a direction in which a document read by the reading section 2 should be discharged. A document discharge tray 18 receives a document driven out via the direction selector 17. Mirrors 19 and 20 and a fluorescent lamp 21 scan a document. A lens 22 focuses the resulting reflection or image light to a CCD (Charge Coupled Device) image sensor or similar image sensor 23.

Among the above constituents of the image reading section 2, the document feed tray 11, roller pair 12, roller 13, guides 14 and 15, belt 16, direction selector 17 and document discharge tray 18 are mounted on a conventional cover plate, not shown, constituting an ADF (Automatic Document Feeder) unit 24. The ADF unit 24 may be angularly moved toward and away from the glass platen 10 by hand.

The paper feeding section 3 arranged in the lower portion of the casing 9 includes a first tray 28, a second tray 29, a third tray 30, and a fourth tray 25 each constituting a paper stocking portion.

The first and second trays 28 and 29 allow papers P1 and P2 of the same size to be stacked thereon. The third tray 30 allows papers P3 of relatively large size to be stacked thereon. The fourth tray 25 allows papers P4 to be fed by hand. A paper shifter 31 shifts the entire paper stack P2 from the tray 29 to the tray 28 when the papers P1 on the tray 28 are used up. Pick-up rollers 32, 33 and 26 respectively feed the papers P1, P3 and P4 one by one. Pressers 34 and 35 press the papers P1 and P3 against the pick-up rollers 32 and 33, respectively. Separation roller pairs 37, 38 and 27 are respectively associated with the pick-up rollers 32, 33 and 26, and each separates the top paper from the underlying papers. Additionally included in the paper feeding section 3 are roller pairs 39 and 40 and a group of rollers 41 for conveyance, and a registration roller pair 42.

The second tray 29 may be pulled out of the casing 9 while the printer 1 is in operation. This kind of configuration is taught in, e.g., Japanese Patent Laid-Open Publication No. 5-124737 mentioned earlier. A substantially linear paper transport path extends from the fourth tray 25 into the casing 9 for allowing relatively thick papers, envelopes and other special papers to be fed.

Figure 2:
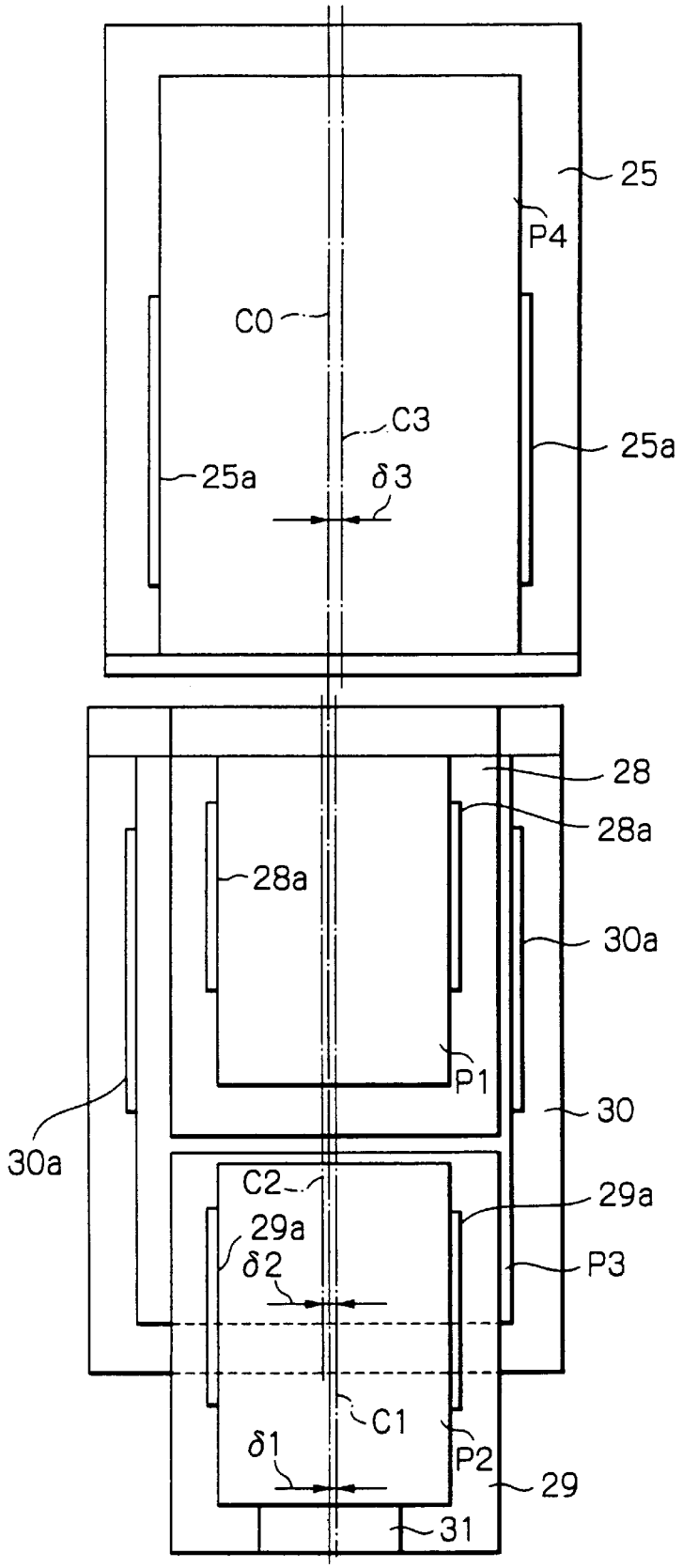
FIG. 2 is a fragmentary plan view of a paper feeding section included in the embodiment of FIG. 1 and an alternative embodiment of the present invention.

FIG. 2 shows major part of the paper feeding section 3 in a plan view, i.e., in the direction in which the papers P1–P4 are fed downward. As shown, the trays 28 and 29 arranged linearly side by side have a common center line C1 while the tray 30 has a center line C2. The tray 25 has a center line C3. The center lines C1–C3 each are deviated from the center line C0 of a paper transport path defined in the casing 9 by a particular amount for design and allowance reasons. Specifically, in FIG. 2, the center line C1 is deviated to the right by an amount $\delta 1$ while the center line C2 is deviated to the left by an amount $\delta 2$. The center line C3 is deviated to the right by an amount $\delta 3$.

As also shown in FIG. 2, the trays 28 and 29 respectively include a pair of side fences 28*a* and a pair of side fences 29*a* for guiding the associated papers P1 and P2 in the widthwise direction. Likewise, the trays 30 and 25 respectively include a pair of side fences 30*a* and a pair of side fences 25*a* for guiding the associated papers P3 and P4 in the widthwise direction. The side fences 28*a*, 29*a*, 30*a* and 25*a* are respectively removably mounted to the trays 28, 29, 30 and 25 by, e.g., fastening or insertion. Specifically, the paired side fences are engageable with the associated tray at positions equally spaced from the associated center line in the right-and-left direction and corresponding to a desired paper size. The papers P1, P2, P3 and P4 are therefore respectively stacked on the trays 28, 29, 30 and 25 with their center lines aligning with the center lines C1, C2 and 03. The centerlines C1–C3 each define the centerline of a transport path for particular one of the papers P1–P4.

Referring again to FIG. 1, a first paper sensor 36 is positioned above the first tray 28 and senses the papers P1 stacked on the tray 28 and pushed up by the presser 34 when contacting the papers P1. A first paper size sensor or paper size sensing means 45 is positioned below the tray 28 and made up of a plurality of shield type sensors. The paper size sensor 45 determines the size of the papers P1 on the basis of the output of any one of the sensors shielded by the papers P1.

A second paper sensor 43 and a second paper size sensor or paper size sensing means 46 are arranged below the second tray 29. The sensors 43 and 46 are respectively responsive to the presence/absence of the papers P2 on the second tray 29 and the size of the papers P2. The sensor 43 is a conventional reflection type sensor and senses the papers P2 via a hole, not shown, formed in the tray 29. The sensor 46 is identical in configuration with the sensor 45 assigned to the first tray 28.

A third paper sensor 44 identical with the first paper sensor 36 is positioned above the third tray 30 and responsive to the papers P3 stacked on the tray 30. A third paper size sensor or paper size sensing means 47 identical with the first paper size sensor 45 is positioned below the tray 30 and responsive to the papers P3 stacked on the tray 30.

A fourth paper sensor 55, like the second paper sensor 43, is located below the fourth tray 25 and responsive to the papers P4 stacked on the tray 25. A fourth paper size sensor or paper size sensing means 56, like the first paper size sensor 45, is positioned below the tray 25 for sensing the size of the papers P4.

The trays 28–30, paper shifter 31, rollers 32 and 33, pressers 34 and 35, roller pairs 37 and 38, sensors 36 and 43–47 and roller pair 39 constitute a multistage paper feeding section 155.

The master making section 4 arranged above the paper feeding section 3 includes a support member 49 supporting a stencil 48 in the form of a roll 48*a*. A thermal head 50 perforates, or cuts, the stencil 48 by heating it. A platen roller 51 presses the stencil 48 against the thermal head 50 while conveying the stencil 48. Cutting means 52 cuts the stencil 48 at a preselected length. Roller pairs 53 and 54 convey the stencil 48. The master making section 4 is constructed into a unit removable from the casing 9.

Specifically, the stencil roll 48*a* includes a core 48*b* rotatably supported by the support member 49. A stepping motor, not shown, causes the platen roller 51 to rotate while moving means, not shown, selectively moves the platen roller 51 to a first position indicated by a solid line in FIG. 1 or a second position indicated by a dash-and-dots line. At the first position, the platen roller 51 is pressed against the thermal head 50 by a preselected pressure. At the second position, the platen roller 51 is spaced from the thermal head 50. The cutting means 52 has a conventional configuration in which an upper edge 52*a* is rotatable or movable up and down relative to a lower edge 52*b*.

The printing section 5 is arranged at the left of the master making section 4, as viewed in FIG. 1. The printing section 5 includes an ink drum 60, ink feeding means 61, and a press roller 62 for pressing the paper P1, P2, P3 or P4 (collectively paper P hereinafter) against the outer periphery of the ink drum 60.

The ink drum 60 is made up of a hollow cylindrical, porous support member and a laminate of mesh screens covering the outer periphery of the support member and formed of resin or metal. The ink drum 60 is affixed to flanges, not shown, rotatably mounted on a shaft 63 which plays the role of an ink feed pipe at the same time. Drum drive means, not shown, causes the ink drum 60 to rotate in synchronism with the registration roller pair 42. The ink drum 60 is removably mounted on the casing 9. A damper 64 is mounted on the outer periphery of the ink drum 60 for clamping the leading edge of the perforated part of the stencil 48 (master 48 hereinafter). Opening/closing means, not shown, causes the damper 64 to open and then close when the ink drum 60 reaches a preselected angular position.

An image position adjusting mechanism (see Japanese Patent Laid-Open Publication No. 6-293175 mentioned earlier), a drum position sensor 69 and a master absence sensor 137 are arranged around the ink drum 60. The image position adjusting mechanism is driven by a motor or drum shifting means 57 to shift the ink drum 60 in the axial direction of the shaft 63, thereby shifting an image to be printed on the paper P in the width wise direction of the paper P. The drum position sensor 69 is responsive to the position of the ink drum 60 in the above direction. The master absence sensor 137 is responsive to the absence of the master 48 on the outer periphery of the ink drum 60.

More specifically, the drum position sensor 69 determines the position of the ink drum 60 in terms of a shift of the drum 60 from a preselected home position which is coincident with the centerline C0. The master absence sensor 137 is implemented by a reflection type sensor and adjoins the damper 64 when the ink drum 60 is brought to a preselected home position in the circumferential direction, thereby determining whether or not the master 48 is present. When the sensor 137 determines that the master 48 is absent on the ink drum 60, a step of discharging a used master from the ink drum 60, which will be described later, is omitted at the time of master making.

The ink feeding means 61 disposed in the ink drum 60 includes an ink roller 65 and a doctor roller 66 in addition to the shaft 63. The ink roller is rotatably supported by side plates, not shown, affixed to the shaft 63. Drive transmitting means, not shown, including gears and a belt transfers a driving force to the ink roller 65 and causes it to rotate clockwise, as viewed in FIG. 1. The doctor roller 66 adjoins the ink roller 65 such that the outer periphery of the roller 66 is parallel to the outer periphery of the roller 65. The ink roller 65 and doctor roller 66 form a generally wedge-shaped ink well 67 therebetween. Ink in the ink well 67 is drawn out while passing through a gap between the two rollers 65 and 66, forming a thin film on the roller 65.

The press roller 62 is positioned beneath the ink drum 60 and supported by opposite side walls, not shown, of the casing 9 in such a manner as to be rotatable and angularly movable. A cam, for example, causes the press roller 62 to angularly move into and out of contact with the ink drum 60, although not shown specifically. A spring or similar biasing means, not shown, constantly biases the press roller 62 toward the ink drum 60. When the press roller 62 is moved away from the ink drum 60, locking means, not shown, locks the roller 62 in a spaced position shown in FIG. 1.

The paper discharging section 6 arranged at the left of the printing section 5, as viewed in FIG. 1, includes a peeler 71, guides 72 and 73, a conveyor 74, and an electrically driven rack 75. The peeler 71 peels off the paper or printing P wrapped around the ink drum 60. The peeler 71 is pivotally supported by the sidewalls of the casing 9 such that the edge thereof is movable toward and away from the ink drum 60. The guides 72 and 73 are affixed to the sidewalls of the casing 9 for guiding the printing P separated from the ink drum 60 by the peeler 71. The conveyor 74 is made up of a drive roller 76, a driven roller 77, an endless belt 78 passed over the two rollers 76 and 77, and a suction fan 79. While the suction fan 79 sucks the printing P onto the belt 78, the belt 78 is driven by the drive roller 76 to convey the paper P in the direction indicated by an arrow in FIG. 1.

The paper P conveyed by the conveyor 74 is discharged to the electrically driven rack 75. The rack 75 includes a tray 80 to be loaded with the papers or printings P, a pair of side fences 81, an end fence 83, and a rack body 109. The rack 75 locates each of the side fences 81 and end fence 83 at a particular position on the basis of a paper size signal output from the paper feeding section 3. In addition, the rack 75 positions the tray 80 in accordance with the deviations of the trays 28, 29, 30 stored in storing means which will be described later. The rack body 109 is mounted on the casing 9 such that when the tray 80 is held at a home position, its centerline coincides with the centerline C0.

Figure 3:
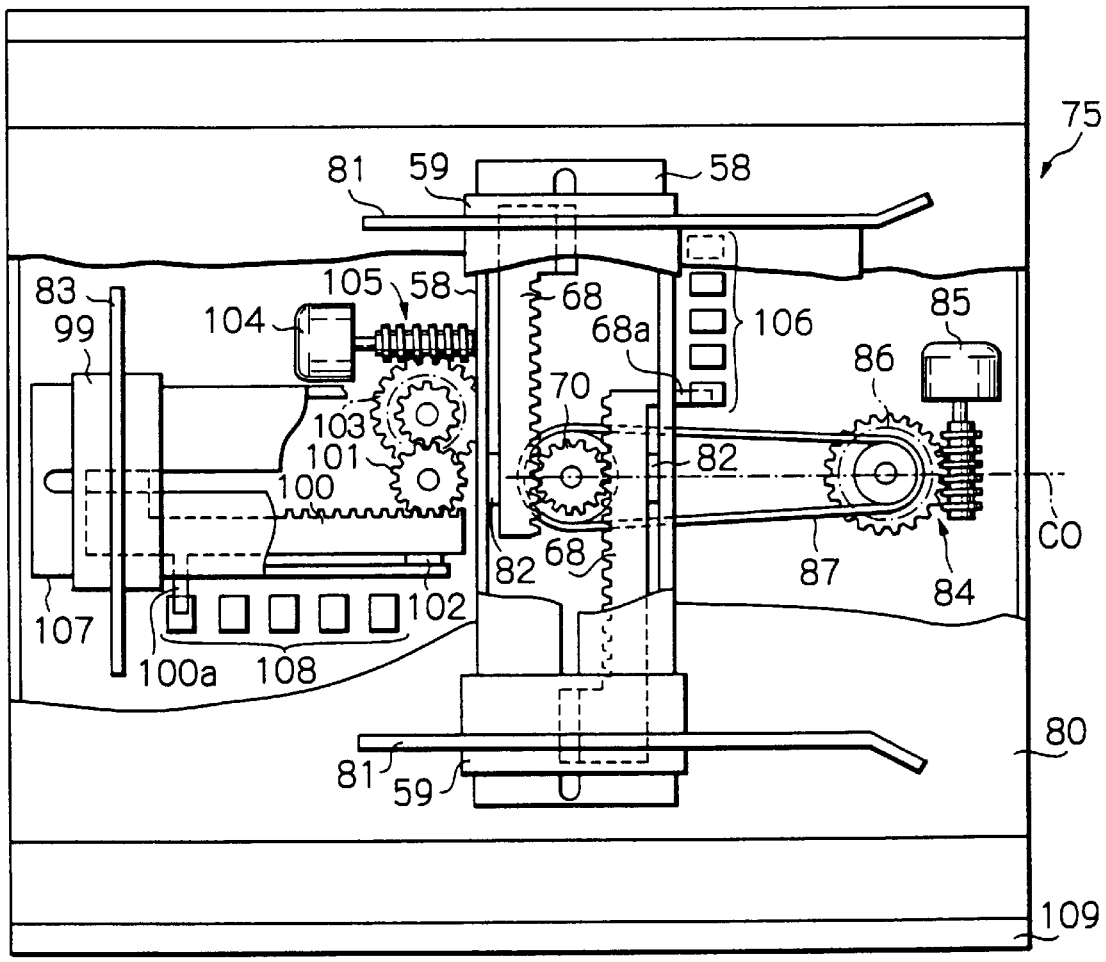
FIG. 3 is a partly sectional plan view of an electrically driven rack also included in the embodiment of FIG. 1 and alternative embodiment.

As shown in FIG. 3, the above tray 80 has a generally box-like configuration. The side fences 81 each are mounted on a respective slider 59 slidable on and along guide rails 58 which are mounted on the tray 80. A rack 68 is mounted on the bottom of each slider 59. A pinion gear 70 is positioned on the centerline C0 of the tray 80 at the intermediate between the side fences 81. The surface of each rack 68 opposite to the surface meshing with the pinion gear 70 is slidably supported by a slide guide 82 mounted on the guide rail 58. A motor or side fence shifting means 85 drives a speed reduction mechanism 84 including an electromagnetic clutch 86. The pinion gear 70 is operatively connected to the speed reduction mechanism 84 by a timing belt 87. When the motor 85 is energized and the electromagnetic clutch 86 is coupled, the side fences 81 are shifted toward or away from each other symmetrically with respect to the center line C0, i.e., in the widthwise direction of the paper P.

The end fence 83, like the side fences 81, is mounted on a slider 99 which is, in turn, slidable on a guide rail 107 disposed in the tray 80. A rack 100 is mounted on the bottom of the slider 99 and held in mesh with a gear 101. The surface of the rack 100 opposite to the surface meshing with the gear 101 is slidably supported by a slide guide 102 mounted on the guide rail 107. The gear 100 is operatively connected to a speed reduction mechanism 105 including an electromagnetic clutch 103 and driven by a motor 104. When the motor 104 is energized and the electromagnetic clutch 103 is coupled, the end fence 83 is shifted in the direction in which the paper is conveyed (direction of paper conveyance hereinafter).

A side fence sensor 106 adjoins one of the racks 68 for sensing the position of the side fence associated with the rack 68. Likewise, an end fence sensor 108 adjoins the rack 100 for sensing the position of the end fence 83. The sensors 106 and 108, like the first paper size sensor 45, each is made up of a plurality of shield type sensors. Tongues 68*a* and 100*a* respectively extend out from the surfaces of the racks 68 and 100 opposite to the meshing surfaces. The position of the fence 81 or 83 is determined on the basis of the sensor shielded by the tongue 68*a* or 100*a*, respectively. This kind of sensing configuration is conventional.

Figure 4:
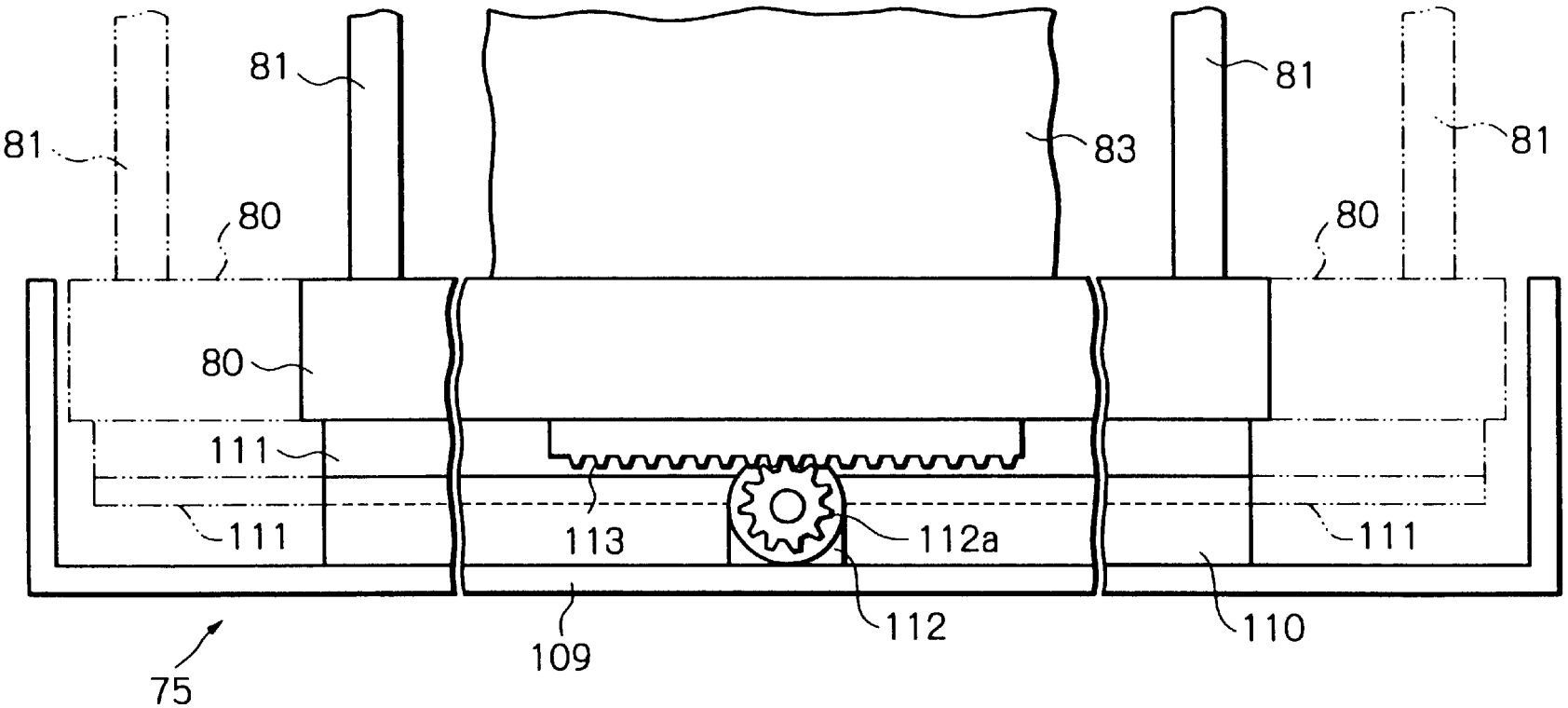
FIG. 4 is a partly sectional side elevation of the rack shown in FIG. 3.

As shown in FIG. 4, a rail member 110 is disposed in the rack body 109. A slider 111 is mounted on the bottom of the tray 80 and slidable on and along the rail member 110. A stepping motor or rack shifting means 112 includes a pinion gear 112*a* and disposed in the rack body 109 upstream of the rail member 110 in the direction of paper conveyance. The pinion gear 112*a* is held in mesh with a rack 113 mounted on the bottom of the tray 80. Control means 133 (see FIG. 6) controls operation of the stepping motor 112, as will be described specifically later.

As shown in FIG. 1, the master discharging section 7 is located above the paper discharging section 6 and includes an upper discharge member 88, a lower discharge member 89, a box 90 for collecting used masters, and a compressor 91.

The upper discharge member 88 is made up of a drive roller 92, a driven roller 93, and an endless belt 94 passed over the two rollers 92 and 93. The drive roller 92 rotates clockwise, as viewed in FIG. 1, causing the belt 94 to move in the direction indicated by an arrow. Likewise, the lower discharge member 89 is made up of a drive roller 95, a driven roller 96, and an endless belt 97 passed over the rollers 95 and 96. The drive roller 95 rotates counterclockwise, as viewed in FIG. 1 to move the belt 97 in the direction indicated by an arrow. Moving means, not shown, selectively moves the lower discharge member 89 to a position shown in FIG. 1 or a position where the circumference of the drive roller 95 contacts a used master 98 wrapped around the ink drum 60. Lowering means, not shown, selectively lowers the compressor 91 into the box 90 for compressing the used master 98 collected in the box 90. The two discharge members 88 and 89, box 90 and compressor 91 are constructed into a unit removable from the casing 9.

Figure 5:
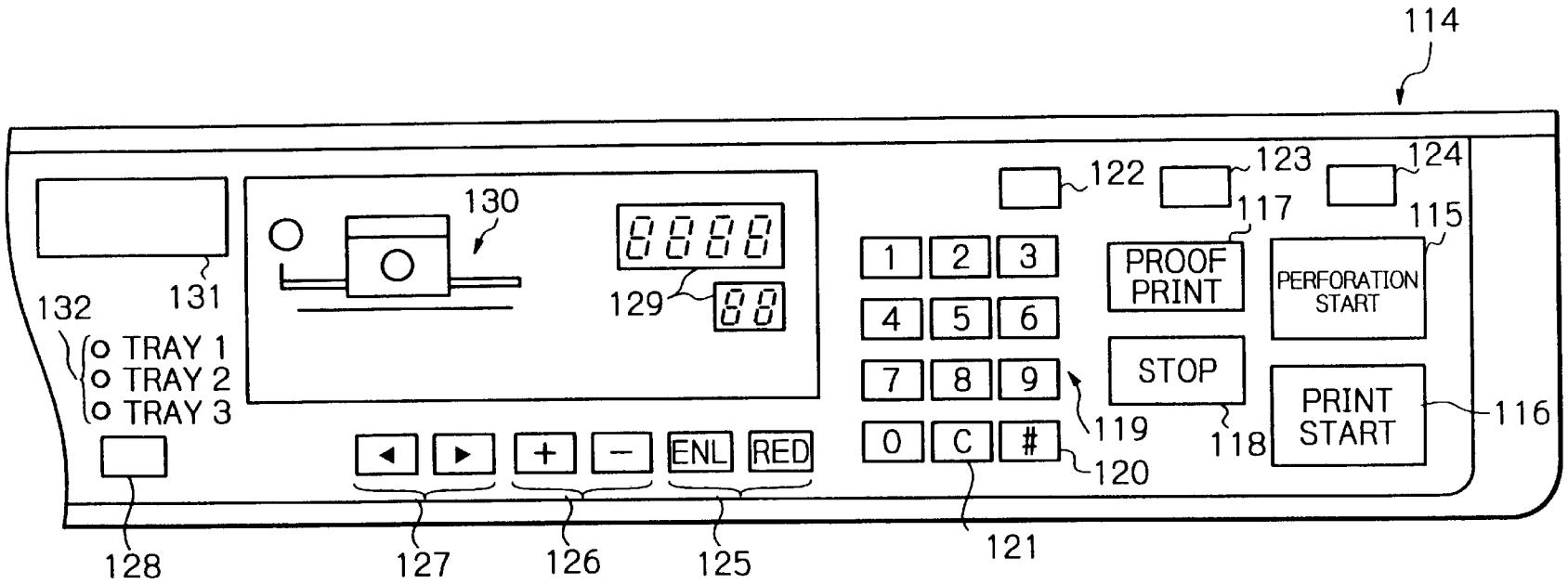
FIG. 5 is a plan view showing an operation panel further included in the embodiment of FIG. 1 and alternative embodiment.

FIG. 5 shows a specific arrangement of a control panel 114 mounted on the front part of the top of the stencil printer 1. As shown, the control panel 114 includes a perforation start key 115 for starting a master making operation, a print start key 116, a proof print key 117, a stop key 118, numeral keys 119, an enter key 120, a clear key 121, a program key 122, a mode key 123, a mode clear key 124, enlarge/reduce keys 125, print speed keys 126, image position keys 127, a tray key 128, a display 129 implemented by seven-segment LEDs (Light Emitting Diodes), a display 130 implemented by an LCD (Liquid Crystal Display), an error display 131 for displaying, e.g., a jam and implemented by LEDs, and indicators 132 for showing a tray selected on the tray key 128 and implemented by LEDs. Operation commands input on the control panel 114 are sent to the control section 8, FIG. 1.

The image position keys 127 allow the operator of the printer 1 to shift the position of an image to be printed in the right-and-left direction, i.e., the widthwise direction of the paper P. Usually, the keys 127 each cause the motor 57 to operate for shifting the ink drum 60 inthe widthwise direction of the paper P by any desired amount. In a serviceman program mode, which will be described later, a serviceman is allowed to operate the keys 127 in combination with the mode key 123 for shifting the tray 80 of the rack 75 in the widthwise direction of the paper P by any desired amount via the stepping motor 112.

The tray key 128 allows the operator to select one of the first tray 28, third tray 30 and fourth tray 25 loaded with desired papers P; every time the operator presses the key 128, one of the indicators or tray indicating means 132 turns on. In the illustrative embodiment, TRAYS 1–3 on the control panel 114 correspond to the first tray 28, third tray 30 and fourth tray 25, respectively. In addition, every time the key 128 is pressed, the size of papers P stacked on the desired tray appears on the display 130 on the basis of the output of the paper size sensor 45, 47 or 56.

Figure 6:
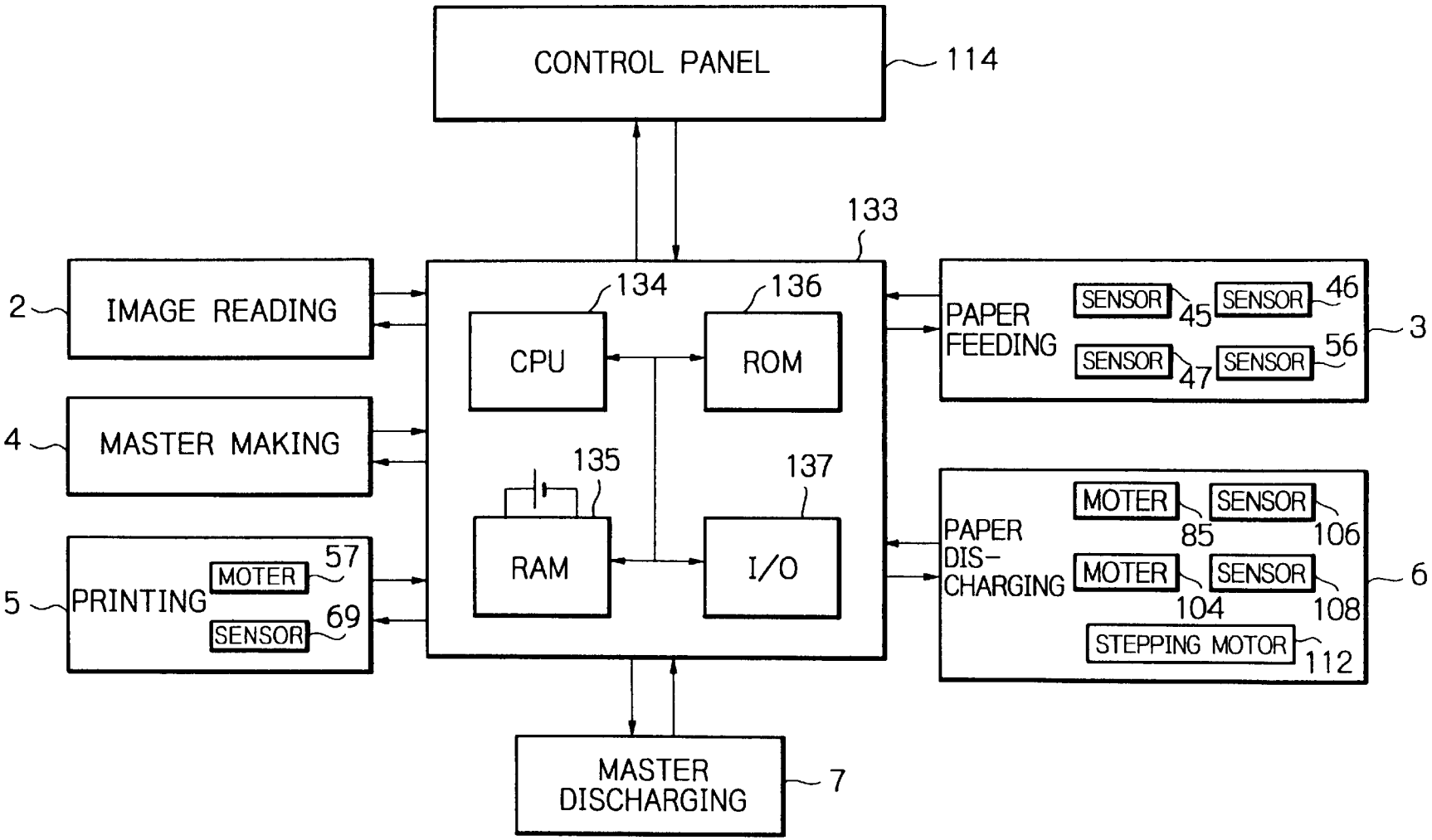
FIG. 6 is a block diagram schematically showing control means particular to the embodiment of FIG. 1.

FIG. 6 shows the previously mentioned control means 133 constituting the major part of the control section 8, FIG. 1, disposed in the casing 9. As shown, the control means 133 is implemented by a conventional microcomputer including a CPU (Central Processing Unit) 134, a RAM (Random Access Memory) 135, a ROM (Read Only Memory) 136, and an I/O (Input/Output) expander 137. The control means 133 controls the entire printer 1.

The CPU 134 receives the output signals of the various sensors and control panel 114. The image reading section 2, paper feeding section 3, master making section 4, printing section 5, paper discharging section 6 and master discharging section 7 each are connected to the CPU 134 via a respective driver. The CPU 134 performs, based on a program stored in the ROM 136 beforehand, operations with the signals input from the sensors and control panel 114 and sends a particular control signal to the driver of each of the above sections 2–7. At the same time, the CPU 134 sends display signals to the control panel 114.

The CPU 134 temporarily writes the program read out of the ROM 136 in the RAM 135. The program written to the RAM 135 may be rewritten via the control panel 114, as desired. Further, when the center lines C1–C3 of the first tray 28, third tray 30 and fourth tray 25 should be brought into alignment with the center line C of the casing 9, the deviations $\delta 1$, $\delta 2$ and $\delta 3$ stated earlier are written to the RAM 135 by a procedure to be described later; in this sense, the RAM 135 plays the role of storing means.

More specifically, the ROM 136 stores a plurality of different programs for operating various actuators included in the printer 1. Among them, a program for causing the center lines C1, C2 and C3 to coincide with the center line C0 is implemented as a program for operating the motor 57 and stepping motor 112.

The printer 1 having the above construction will be operated as follows. First, a procedure for causing the centerlines C1–C3 to align with the center line C0 will be described. This procedure is effected only at the manufacturer's station before shipment, but cannot be done by the user after shipment.

Specifically, a worker at the manufacturer's station calls the previously mentioned serviceman program mode by operating the program key 122, mode key 123 and so forth arranged on the control panel 114.

The serviceman program mode can be called only if the keys are manipulated in a preselected manner or if a password, for example, is input. This inhibits the user from calling the serviceman program mode.

Assume that the worker called the serviceman program mode presses the tray key 128 to select TRAY 1. In response, the control means 133 sends a particular drive signal to each of the motors 85, 104 and stepping motor 112. As a result, the tray 80 of the electrically driven rack 75 is brought to its home position. At the same time, the side fences 81 and end fence 83 each are moved to a particular home position outside of a position corresponding to a maximum paper size available with the printer 1, then moved to a preselected position corresponding to the size of the papers P1 sensed by the paper size sensor 45, and then stopped on the basis of the output of the fence sensor 106 or 108. At this instant, the control means 133 locates the ink drum 60 at its axial home position and clears the area of the RAM 135 expected to store the deviations δ1, δ2 and δ3 which will be described specifically later.

After the selection of TRAY 1, the worker lays a single document on the document feed tray 11 and then presses the perforation start key 115. In response, the document reading section 2 reads the document and sends an image data signal representative of the document to the control means 133.

The master discharging section 7 performs a master discharging operation in parallel with the image reading operation of the document reading section 2. Initially, however, the used master 98 is absent on the ink drum 60. Therefore, in response to the master absence sensor 137, the master discharging operation is omitted. After the ink drum 60 has been rotated to a preselected master feed position, the control means 133 causes the opening/closing means to open the damper 64. The ink drum 60 is held in a stand-by position for waiting for the master 48.

The document reading operation is followed by a master making operation. Specifically, when the ink drum 60 reaches the stand-by position, the control means 133 energizes the stepping motor, not shown, for causing it to rotate the platen roller 51 and rollers 53 and 54. As a result, the stencil 48 is paid out from the roll 48*a l and perforated by the thermal head 50, as stated previously.*

The perforated part of the stencil, i.e., the master 48 is conveyed toward the damper 64. When the control means 133 determines, in terms of the number of steps of the stepping motor, that the leading edge of the master 48 has reached a position where it is ready to be clamped by the damper 64, the control means causes the opening/closing means to close the damper 64. The damper 64 therefore retains the leading edge of the master 48 on the ink drum 60.

Subsequently, the ink drum 60 is rotated clockwise, as viewed in FIG. 1, at a peripheral speed equal to the conveyance speed of the master 48, so that the master 48 is sequentially wrapped around the ink drum 60. When the control means 133 determines, in terms of the number of steps of the stepping motor, that a single master 48 has been completed, the control means 133 causes the platen roller 51 and roller pairs 53 and 54 to stop rotating. At the same time, the control means 133 causes the upper edge 52*a* to move relative to the lower edge 52*b* for thereby cutting off the master 48. The ink drum 60 in rotation pulls the cut master 48. When the ink drum 60 again reaches its circumferential home position, it is brought to a stop to end the master wrapping operation.

After the master 48 has been wrapped around the ink drum 60, a trial printing is produced, as follows. Before the end of the master wrapping operation, the control means 133 causes the presser 34 to press the first tray 28 upward until the top of the stack of papers P1 contacts the pick-up roller 32. Then, the control means 133 stops elevating the presser 34 and thereby locates the first tray 28 at a preselected paper feed position.

After the ink drum 60 has been stopped at the circumferential home position, the control means 133 causes the drum 60 to start rotating at a low speed and causes the pick-up roller 32, separation roller pair 37, roller pair 40 and roller group 41 to start rotating. The pick-up roller 32 and separation roller pair 37 cooperate to pull out the top paper P from the first tray 28. The registration roller pair 42 nips the leading edge of the paper P1 fed from the tray 28.

When the leading edge of the image area of the master 48 wrapped around the ink drum 60 reaches a position corresponding to the press roller 62, the control means 133 causes the registration roller pair 42 to start rotating and driving the paper P1 toward the gap between the ink drum 60 and the press roller 62. The control means 133 actuated the registration roller pair 42, as stated above, causes the locking means to unlock the press roller 62. As a result, the press roller 62 is angularly moved toward the ink drum 60.

The press roller 62 presses the paper P1 fed from the registration roller pair 42 against the master 48 existing on the ink drum 60. Consequently, the paper P1 and master 48 are pressed between the press roller 62 and the ink drum 60. Ink fed to the inner periphery of the ink drum 60 by the ink roller 65 penetrates through the porous support and mesh screens of the ink drum 60 and then fill is the interstice between the ink drum 60 and the master 48. Finally, the ink is transferred from the ink drum 60 to the paper P1 via the perforations of the master 48.

The peeler 71 peels off the paper P1 carrying the ink thereon from the ink drum 60 while introducing it into the gap between the guides 72 and 73. The paper P1 is conveyed to the left, as viewed in FIG. 1, by the belt 78 while being held on the belt 78 by the suction of the suction fan 79. As a result, the paper or trial printing P1 is driven out to the tray 80.

On completing the above sequence of steps, the printer 1 waits for an actual printing operation. The worker checks the trial printing P1 driven out to the tray 80 by eye so as to determine to which side and how much the position of the printed image is deviated from the center line of the printing P1. In the illustrative embodiment, the image is assumed to be deviated to the front side of the printer 1 by the amount δ1, as shown in FIG. 2. Subsequently, the worker causes the motor 57 and stepping motor 112 to operate via the mode key 123 and image position key 127 such that the ink drum 60 and tray 80 are shifted to the front side by the above amount δ1. Such a shift of theinkdrum 60 and tray 80 is digitally displayed on the display 129.

After the positioning of the ink drum 60 and tray 80, the worker presses the proof print key 117. In response, another paper P1 is fed from the first tray 28 and nipped by the registration roller pair 42 in the same manner as the first paper P1. At the same time, the ink drum 60 is caused to rotate at a high speed at the same timing as in the trial printing procedure. The registration roller pair 42 drives the paper P1 toward the gap between the ink drum 60 and the press roller 62. The paper P1 is pressed against the master 48 present on the ink drum 60 by the press roller 62 with the result that the ink is transferred to the paper P1 for forming an image. Again, the peeler 71 removes the paper P1 from the ink drum 60, and the conveyor 74 conveys the paper P1 to the tray 80. As soon as the ink drum 60 is returned to the circumferential home position, the proof printing procedure ends.

Assume that the worker watching the above paper or proof printing P1 determines that the position of the image is coincident with the center line of the paper P1. Then, the worker operates the program key 122, mode key 123 and so forth to call a program for writing the deviation in the RAM 135 of the control means 133. At this stage of procedure, the worker has already selected TRAY 1 on the tray key 128 (TRAY 1 included in the tray indicating means 132 turning on) and has shifted the ink drum 60 and tray 80 to the front side by δ1. In this condition, the worker presses, e.g., the enter key 120 with the result that the deviation of the center line C1 of the first tray 28 from the center line C0 of the paper transport path (δ1 to the front side) is written to the RAM 135.

Next, the worker selects TRAY 2 on the tray key 128. Zero is stored in the area of the RAM 135 assigned to the deviation of TRAY 2, as stated earlier. Therefore, the ink drum 60 is brought to its axial home position. Subsequently, the worker presses the perforation start key 115. In response, the printer 1 executes the master making step, master feeding step and trial printing step to thereby output a paper or trial printing P3 to the tray 80. The worker measures the deviation of an image printed on the paper P3, causes the ink drum 60 and tray 80 to move to the rear side of the printer 1 by δ2, and then presses the proof print key 117. When another paper or proof printing P3 is driven out to the tray 80, the worker determines whether or not an image printed on the paper P3 is coincident with the center line of the paper P3. If the answer of this decision is positive, the worker again calls the program for writing a deviation in the RAM 135 and then presses the enter key 120.

As a result, the deviation of the center line C2 of the third tray 3 from the center line C0 (δ2 to the rear side) is written to the RAM 135.

The worker repeats the above procedure described in relation to TRAY 2 with TRAY 3 so as to determine the deviation of a paper P4 driven out to the tray 80. The steps to follow are the same as in the above procedure except that the ink drum 60 and tray 80 are shifted to the front side by δ3, and that the deviation δ3 between the center lines C3 and C0 is written to the RAM 135.

On confirming that the deviations of the trays 28, 30 and 25 have been written to the RAM 135, the worker escapes from the serviceman program mode by operating the program key 122, mode key 123 and so forth. The centerlines C1, C2 and C3 of the trays 28, 30 and 25 are now coincident with the centerline C0 of the casing 9.

The printer 1 is operated at the user's station, as follows. First, the operator at the user's station lays a desired document on the document feed tray 11 and selects a desired tray on the tray key 128. The tray indicator 132 displays the tray selected. The operator may operate either one of the enlarge/reduce keys 125 for selecting a desired magnification. In the following description, assume that the operator selects TRAY 3 (fourth tray 25) on the tray key 128.

When the operator presses the perforation start key 115, the image reading section 2 reads the document while sending an image data signal representative of the document to the control means 133. In the paper feeding section, the elevating means raises the fourth tray 25 until the top of the paper stack P4 contacts the pick-up roller 26.

When the operator presses the perforation start key 115, the deviation of the centerline C3 of the fourth tray 25 is read out of the ROM 136. The control means 133 causes the motor 57 and stepping motor 112 to automatically shift the ink drum 60 and tray 80 to the front side of the printer 1 by δ3. Further, the control means 133 drives the motors 85 and 104 such that the si de fences 81 and end fence 83 each are located at the respective home position and then moved to a particular position matching with the size of the papers P4 as determined by the fourth paper size sensor 56. After the fences 81 and 83 have been positioned on the basis of the outputs of the fence sensors 106 and 108, respectively, the suction fan 79 is driven.

The master discharging section 7 removes the used master 98 from the ink drum 60 in parallel with the operation of the image reading section 2, as stated earlier. Of course, when the printer 1 is operated for the first time at the user's station, such a master discharging operation is omitted because a used master is absent on the ink drum 60.

The drum drive means, not shown, causes the ink drum 60 with the used master 98 wrapped therearound to rotate counterclockwise, as viewed in FIG. 1. When the control means 133 determines that the trailing edge of the used master 98 has reached a preselected discharge position corresponding to the drive roller 95, the control means 133 causes the drive means and moving means to rotate the drive rollers 92 and 95 and move the lower discharge member 89 toward the ink drum 60. At the time when the drive roller 95 contacts the used master 98, the ink drum 60 is rotating counterclockwise. Therefore, the used master 98 picked up by the drive roller 95 is nipped by the upper discharge roller 89 and lower discharge roller 88 and peeled off from the drum 60 thereby. Thereafter, the used master 98 is conveyed to the box 90 by the discharge members 89 and 88 and compressed in the box 90 by the compressor 91.

After the used master 98 has been fully removed from the ink drum 60, the ink drum 60 is further rotated to the previously mentioned master feed position. Subsequently, the control means 133 causes the opening/closing means to open the camper 64. In this condition, the ink drum 60 waits for a new master. This is the end of the master discharging operation.

The above master discharging operation is followed by the master making operation described previously. The master making operation will not be described specifically in order to avoid redundancy. The difference is that in this case the paper P4 is fed from the fourth tray 25.

After a new master 48 has been wrapped around the ink drum 60 by the previously stated manner, the trial printing step is executed. After the ink drum 60 has been stopped at the circumferential home position, the control means 133 causes the drum 60 to start rotating at the low speed and causes the pick-up roller 26, separation roller pair 27, roller pair 40 and roller group 41 to start rotating. The pick-up roller 26 and separation roller pair 27 cooperate to pull out the top paper P4 from the fourth tray 25. The registration roller pair 42 nips the leading edge of the paper P4 fed from the tray 25.

When the leading edge of the image area of the master 48 wrapped around the ink drum 60 reaches a position corresponding to the press roller 62, the control means 133 causes the registration roller pair 42 to start rotating and driving the paper P4 toward the gap between the ink drum 60 and the press roller 62. The control means 133 actuated the registration roller pair 42, as stated above, causes the locking means to unlock the press roller 62. As a result, the press roller 62 is angularly moved toward the ink drum 60.

The press roller 62 presses the paper P4 fed from the registration roller pair 42 against the master 48 existing on the ink drum 60. Consequently, the paper P4 and master 48 are pressed between the press roller 62 and the ink drum 60.

Ink fed to the inner periphery of the ink drum 60 by the ink roller 65 penetrates through the porous support and mesh screens of the ink drum 60 and then fills the interstice between the ink drum 60 and the master 48. Finally, the ink is transferred from the ink drum 60 to the paper P4 via the perforations of the master 48. At this instant, because the center line of the paper P4 and the center line of the ink drum 60 are in alignment, an image is printed at the center of the paper P4 in the widthwise direction of the paper P4.

The peeler 71 peels off the paper P4 carrying the ink thereon from the ink drum 60 while introducing it into the gap between the guides 72 and 73. The paper P4 is conveyed to the left, as viewed in FIG. 1, by the belt 78 while being held on the belt 78 by the suction of the suction fan 79. As a result, the paper or trial printing P4 is driven out to the tray 80. At this instant, because the center line of the paper P4 and that of the tray 80 are coincident, the paper P4 hits against the end fence 83 and is then accurately positioned between the side fences 81. On completing this operation, the printer 1 waits for an actual printing operation.

In the above condition, the operator presses the proof print key 117. In response, another paper P4 is fed from the first tray 25 and nipped by the registration roller pair 42 in the same manner as the first paper P4. At the same time, the ink drum 60 is caused to rotate at a high speed at the same timing as in the trial printing procedure. The registration roller pair 42 drives the paper P4 toward the gap between the ink drum 60 and the press roller 62. The paper P4 is pressed against the master 48 present on the ink drum 60 by the press roller 62 with the result that the ink is transferred to the paper P4 for forming an image. Again, the peeler 71 removes the paper P4 from the ink drum 60, and the conveyor 74 conveys the paper P4 to the tray 80. As soon as the ink drum 60 is returned to the circumferential home position, the proof printing procedure ends. Again, the center of this paper P4 and the centers of the ink drum 60 and tray 80 are coincident, so that an image is printed at the center of the paper P4 inthe widthwise direction of the paper P4. The paper P4 with such an image is accurately positioned on the tray 80 by being guided by the side fences 81.

The operator may press the image position keys 127 in order to shift an image on the paper P4 for, e.g., providing the paper P4 with a binding margin. In this case, the axial home position of the ink drum 60, of course, includes the deviation of the fourth tray 25, i.e., it is coincident with a position deviated from the center line C0 to the front side by δ3.

If desired, exclusive keys for setting up an image position including abiding margin may be provided on the operation panel 114. The exclusive keys will be used to write, as offset positions, tray-by-tray image positions each including a particular binding margin (deviations from the center line C0) in the RAM 135 of the control means 133 in the same manner as the tray-by-tray deviations δ1–δ3. By combining the exclusive keys with the tray key 128, it is possible to easily and automatically shift any one of the trays 28, 30 and 25 to an image position including a binding margin. In this case, the operator may press the image position keys 127 only when the image position needs fine adjustment.

With the above construction, the illustrative embodiment achieves the following unprecedented advantages. Even when any one of the centers C1, C2 and C3 of the trays 28, 30 and 25, respectively, is deviated from the center C0 of the paper transport path of the casing 9, it is possible to easily and automatically adjust an image position without increasing the cost and to write the adjusted image position in the RAM 135. This allows a plurality of paper stocking portions to be assembled without resorting to high accuracy which would increase the cost. Further, the illustrative embodiment enhances design freedom because it allows the center of the individual paper stocking portion to be shifted for design reasons or similar reasons.

Figure 7:
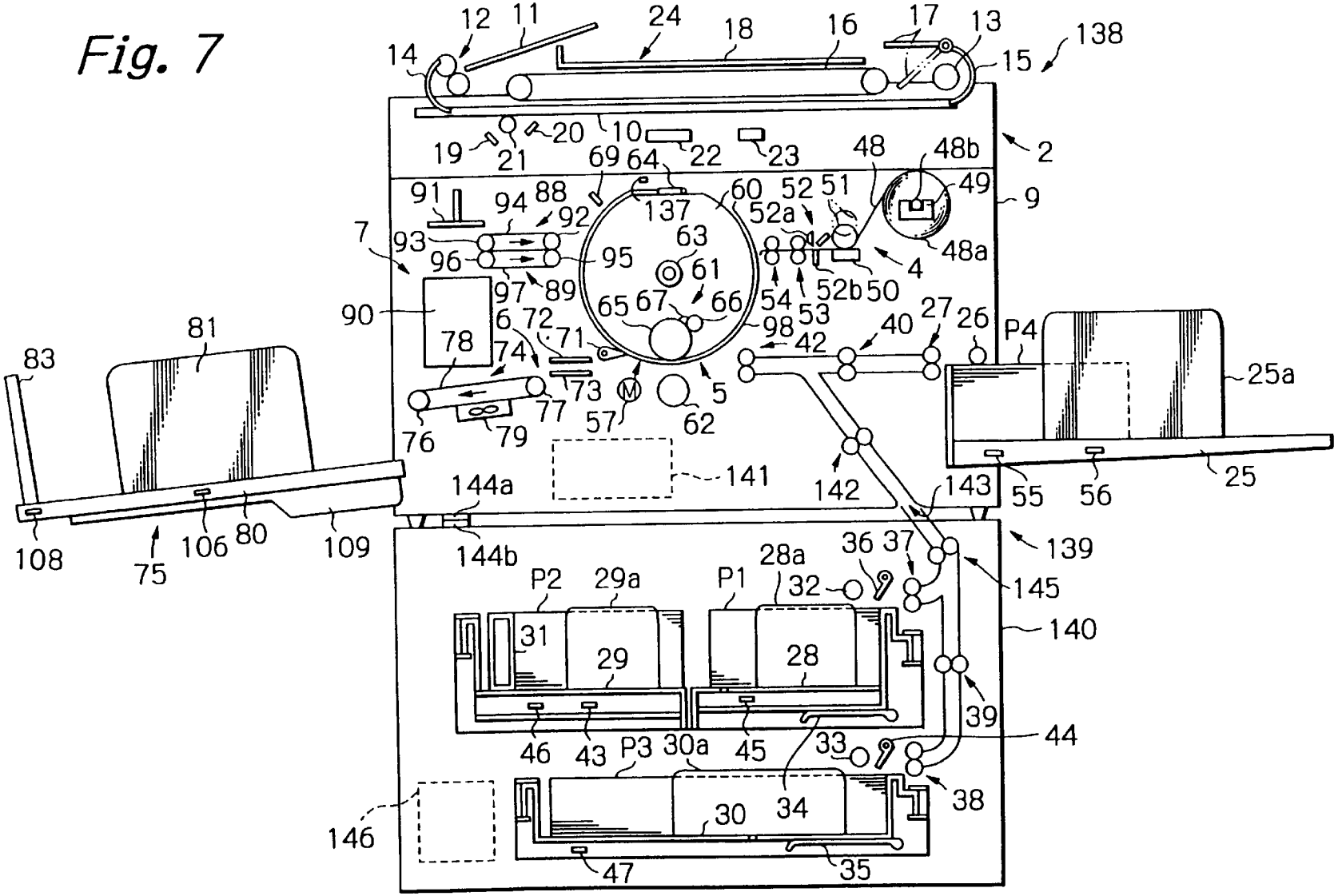
FIG. 7 is a fragmentary front view showing the alternative embodiment.

Referring to FIG. 7, an alternative embodiment of the present invention is shown. As shown, a stencil printer, generally 138, is essentially similar to the previous stencil printer 1 except for the following. A paper feeding section or multistage paper feeding device 139 with a multistage paper feeding section 140 is substituted for the paper feeding section 3. A control section 141 is substituted for the control section 8.

The paper feeding section 139 includes, in addition to the multistage paper feeding section 140 which will be described later, the pair of side fences 25*a*, pick-up roller 26, separation roller pair 27, roller pair 40, fourth paper sensor 55 and fourth paper size sensor 56 as well as an additional roller pair 142. The paper feeding section 139 has a paper transport path including the above roller pair 142 in addition to the paper transport path extending from the fourth tray 25 and including the roller pair 40. The paper transport path including the roller pair 142 extends downward in the casing 9 and terminates at an opening 143 formed in the bottom of the casing 9. A connector 144*a* is mounted on the bottom of the casing 9.

The control section or control means 141 is positioned in the lower portion of the casing 9. The control means 141 is implemented by a microcomputer including a CPU, a ROM and a RAM although not shown specifically. The control means 141 controls the image reading section 2, paper feeding section 139, master making section 4, printing section 5, paper discharging section 6 and master discharging section 7 in accordance with a program stored in the ROM. When the center line C3 of the tray 25 should be aligned with the center line C0 of the casing 9, the deviation δ3 is written to the RAM of the control means 141.

The multistage paper feeding section 140 is bodily removable from the casing 9 and includes the first to third trays 28–30, side fences 28*a*, 29*a* and 30*a*, paper shifter 31, pick-up rollers 32 and 33, pressers 34 and 35, first paper sensor 36, separation roller pairs 37 and 38, roller pair 39, second paper sensor 43, third paper sensor 44 and first to third paper size sensors 45–47 as well as a roller pair 145. A paper transport path downstream of the roller pair 145 in the direction of paper conveyance extends upward in the multistage paper feeding section 140 and is communicable to the opening 143. A connector 144*b* connectable to the connector 144*a* is mounted on the top of the multistage paper feeding section 140, so that power can be supplied from the printer 138 to the multistage paper feeding section 140.

A control section or storing means 146 is located in the lower portion of the multistage paper feeding section 140. The control section 146 is also implemented by a microcomputer including a CPU, a ROM and a RAM although not shown specifically. When the center lines C1 and C2 of the first and third trays 28 and 30, respectively, should be aligned with the center line of the casing 9, the deviations δ1 and δ2 are written to the RAM. When the printer 138 and multistage paper feeding section 140, i.e., the connectors 144*a* and 144*b* are electrically connected together, the control section 146 interchanges signals with the control section 141 for writing the deviations δ1 and δ2 in the RAM and sending the data written in the RAM. A back-up battery is associated with the RAM of the control section 146 so as to hold data stored in the RAM even when the connector 144*b* is disconnected from the connector 144.

In the illustrative embodiment, the multistage paper feeding section 140 includes the storing means 146 for storing the centers C1 and C2 and deviations δ1 and δ2 of the trays 28 and 30, respectively. Therefore, once the deviations are set, the center of the individual paper stocking portion successfully aligns with the center of the paper transport path without the deviations being set all over again later at the time of mounting. The printer 138 is therefore easy to operate. Moreover, by replacing the multistage paper feeding section 140, it is possible to use a number of different paper stocking portions and therefore to realize various kinds of printing.

Figure 8:
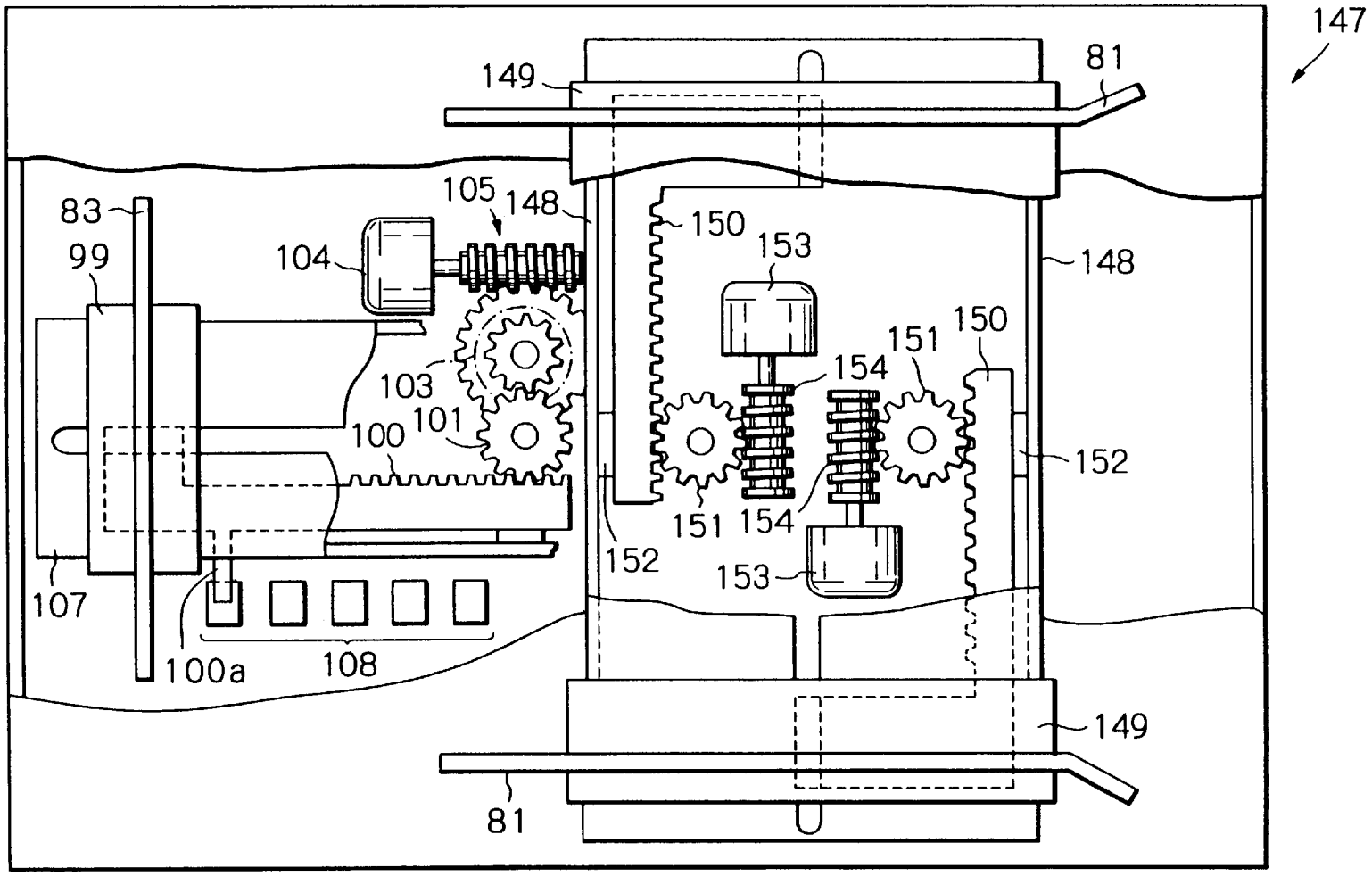
FIG. 8 is a partly sectional plan view of a modification of the rack shown in FIG. 3.

FIG. 8 shows an electrically driven rack 147 representative of a modification of the embodiments described above. As shown, the rack 147 differs from the rack 75 of the previous embodiments in that it does not include the rack body 109, has the tray 80 affixed to the casing 9, and corrects the deviation of any one of the trays 25, 28 and 30 from the casing 9 only by moving the side fences 81. As for the rest of the construction, the rack 147 is identical with the rack 75.

As shown in FIG. 8, the side fences 81 each are mounted on a respective slider 149 slidable on guide rails 148 disposed in the tray 80. A rack 150 is mounted on the bottom of the each slider 149 and held in mesh with a gear 151. The surface of each rack 150 opposite to the surface meshing with the gear 151 is slidably supported by a slide guide 152 mounted on the rail 148. A stepping motor 153, bifunctioning as rack shifting means and side fence shifting means, is drivably connected to the gears 151 via worms 154. In this configuration, the stepping motor 153 causes the side fences 81 to move toward and away from each other in the widthwise direction of the paper.

The control means 133 or the control section 141 operates in relation to the above modification, as follows. The control means 133 or the control section 141 performs calculation with any one of the deviations δ1, δ2 and δ3 of the trays 28, 30 and 25 and the paper size sensed by the associated sensor 45, 47 or 56. The control means 133 or the control section 141 locates, based on the result of the above calculation, one of the side fences 81 at a reference position taking account of the deviation and then positions the other side fence 81 on the basis of the number of steps counted from the reference position.

In the illustrative embodiments, the side fences 28*a*, 29*a*, 30*a* and 25*a* each are mounted to the associated tray 28, 29, 30 or 25 by fastening or insertion. Alternatively, the above side fences, like the side fences 81, may be so arranged as to be movable in the widthwise direction of the paper symmetrically to each other with respect to the associated center lines C1–C3 via a rack and pinion mechanism. In such a case, a construction for automatic movement including drive means and a construction for manual movement not including drive means will be provided together.

The illustrative embodiments each include the first to fourth trays 28, 29, 30 and 25 and essentially use the trays 28, 30 and 25 at the time of printing in a three-stage configuration. Alternatively, four or more trays may be arranged in a multistage configuration.

Further, the pairs of side fences 28*a*, 29*a*, 30*a* and 25*a* respectively provided on the first to fourth trays 28, 29, 30 and 25 each may be replaced with two or more pairs of side fences. In such a case, an arrangement should preferably be made, for a simple construction, such that when one pair of side fences are moved, the other pairs of side fences associated therewith are moved in interlocked relation.

In summary, it will be seen that the present invention provides a stencil printer having various unprecedented advantages, as follows. Even when any one of the centers of paper stocking portions is deviated, it is possible to easily and automatically adjust an image position without increasing the cost and to write the adjusted image position in storing means. This allows a plurality of paper stocking portions to be assembled without resorting to high accuracy which would increase the cost. Further, the stencil printer of the present invention enhances design freedom because it a lows the center of the individual paper stocking portion to be shifted for design reasons or similar reasons.

Various modifications will become possible for those skilled in the art after receiving the teachings of the present disclosure without departing from the scope thereof.

What is claimed is:

1. A stencil printer comprising:

a hollow cylindrical, porous ink drum freely rotatable;

a multistage paper feeding device including a plurality of paper stocking portions and capable of feeding papers of particular kind from each of said plurality of paper stocking portions, wherein at least one pair of side fences are mounted on each of said plurality of paper stocking portions for positioning the papers in a widthwise direction of said papers;

a rack for stacking the papers each carrying a printed image thereon;

ink drum shifting means for shifting said ink drum in the widthwise direction of the papers perpendicular to a direction of conveyance of papers in which said papers are conveyed one by one;

rack shifting means for shifting said rack in the widthwise direction of the papers;

storing means for storing a position of a center line of a paper transport path for each of said plurality of paper stocking portions; and control means for controlling an operation of said ink drum shifting means and an operation of said rack shifting means in accordance with the position of the center line stored in said storing means.

2. A stencil printer as claimed in claim 1, wherein said multistage paper feeding device is removable and includes said storing means.

3. A stencil printer as claimed in claim 2, wherein said storing means is capable of storing any desired offset position.

4. A stencil printer as claimed in claim 3, wherein said rack comprises:

a tray for stacking the papers carrying the printed images; and at least one pair of side fences for positioning the papers in the widthwise direction of said papers;

wherein said rack shifting means shifts either one of said tray and said pair of side fences.

5. A stencil printer as claimed in claim 4, wherein said side fences of said rack are movable in the widthwise direction of the papers in interlocked relation to each other symmetrically with respect to a center of said tray.

6. A stencil printer as claimed in claim 5, further comprising:

a plurality of paper size sensing means each being associated with a particular paper stocking portion for sensing a size of the papers; and side fence shifting means for shifting said side fences of said rack in accordance with the size sensed by any one of said plurality of paper size sensing means.

7. A stencil printer as claimed in claim 2, wherein said rack comprises:

a tray for stacking the papers carrying the printed images; and at least one pair of side fences for positioning the papers in the widthwise direction of said papers;

wherein said rack shifting means shifts either one of said tray and said pair of side fences.

8. A stencil printer as claimed in claim 7, wherein said side fences of said rack are movable in the widthwise direction of the papers in interlocked relation to each other symmetrically with respect to a center of said tray.

9. A stencil printer as claimed in claim 8, further comprising:

a plurality of paper size sensing means each being associated with a particular paper stocking portion for sensing a size of the papers; and side fence shifting means for shifting said side fences of said rack in accordance with the size sensed by any one of said plurality of paper size sensing means.

10. A stencil printer as claimed in claim 1, wherein said storing means is capable of storing any desired offset position.

11. A stencil printer as claimed in claim 10, wherein said rack comprises:

a tray for stacking the papers carrying the printed images; and at least one pair of side fences for positioning the papers in the widthwise direction of said papers;

wherein said rack shifting means shifts either one of said tray and said pair of side fences.

12. A stencil printer as claimed in claim 11, wherein said side fences of said rack are movable in the widthwise direction of the papers in interlocked relation to each other symmetrically with respect to a center of said tray.

13. A stencil printer as claimed in claim 12, further comprising:

a plurality of paper size sensing means each being associated with a particular paper stocking portion for sensing a size of the papers; and side fence shifting means for shifting said side fences of said rack in accordance with the size sensed by any one of said plurality of paper size sensing means.

14. A stencil printer as claimed in claim 1, wherein said rack comprises:

a tray for stacking the papers carrying the printed images; and at least one pair of side fences for positioning the papers in the widthwise direction of said papers;

wherein said rack shifting means shifts either one of said tray and said pair of side fences.

15. A stencil printer as claimed in claim 14, wherein said side fences of said rack are movable in the widthwise direction of the papers in interlocked relation to each other symmetrically with respect to a center of said tray.

16. A stencil printer as claimed in claim 15, further comprising:

a plurality of paper size sensing means each being associated with a particular paper stocking portion for sensing a size of the papers; and side fence shifting means for shifting said side fences of said rack in accordance with the size sensed by any one of said plurality of paper size sensing means.

* * * * *